US011506434B2

(12) United States Patent
Mislak

(10) Patent No.: US 11,506,434 B2
(45) Date of Patent: Nov. 22, 2022

(54) ADJUSTABLE INLET HEADER FOR HEAT EXCHANGER OF AN HVAC SYSTEM

(71) Applicant: Johnson Controls Technology Company, Auburn Hills, MI (US)

(72) Inventor: Nicholas P. Mislak, Bel Air, MD (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 267 days.

(21) Appl. No.: 16/670,212

(22) Filed: Oct. 31, 2019

(65) Prior Publication Data

US 2020/0064038 A1 Feb. 27, 2020

Related U.S. Application Data

(62) Division of application No. 15/611,605, filed on Jun. 1, 2017, now Pat. No. 10,563,895.

(Continued)

(51) Int. Cl.
*F25B 39/00* (2006.01)
*F28F 9/02* (2006.01)

(Continued)

(52) U.S. Cl.
CPC ..... *F25B 49/02* (2013.01); *F25B 39/00* (2013.01); *F25B 39/028* (2013.01); *F28F 9/028* (2013.01);

(Continued)

(58) Field of Classification Search
CPC ..... F25B 49/02; F25B 39/00; F25B 39/028; F25B 2600/2511; F28F 9/0243;

(Continued)

(56) References Cited

U.S. PATENT DOCUMENTS 2,163,591 A 6/1939 Deverall
2,332,336 A * 10/1943 Norris ..... F28B 1/06 165/134.1

(Continued)

FOREIGN PATENT DOCUMENTS

EP 2108909 A1 * 10/2009 ..... F28D 1/05391
JP 7036166 B2 * 3/2022

(Continued)

*Primary Examiner* — Miguel A Diaz
(74) *Attorney, Agent, or Firm* — Fletcher Yoder, P.C.

(57) ABSTRACT

A heat exchanger of an HVAC system including an inlet header, an outlet header, and tubes configured to extend between the inlet header and the outlet header. The system also includes a first interchangeable refrigerant distributor segment of the inlet header, where the first interchangeable refrigerant distributor segment includes first orifices configured to fluidly couple with the tubes to facilitate distribution of refrigerant from the inlet header to the tubes in a first configuration. The system also includes a second interchangeable refrigerant distributor segment of the inlet header, where the second interchangeable refrigerant distributor segment includes second orifices configured to fluidly couple with the tubes to facilitate distribution of refrigerant from the inlet header to the tubes in a second configuration. The first orifices include a first characteristic of an orifice cross-sectional internal boundary size or shape, and the second orifices include a second characteristic of the orifice cross-sectional internal boundary size or shape different than the first characteristic.

20 Claims, 8 Drawing Sheets

Related U.S. Application Data

(60) Provisional application No. 62/431,221, filed on Dec. 7, 2016.

(51) Int. Cl.
*F25B 39/02* (2006.01)
*F25B 49/02* (2006.01)
*F28D 1/047* (2006.01)

(52) U.S. Cl.
CPC ..... *F28F 9/0243* (2013.01); *F28F 9/0265* (2013.01); *F28F 9/0273* (2013.01); *F28F 9/0278* (2013.01); *F25B 2600/2511* (2013.01); *F28D 1/0477* (2013.01)

(58) Field of Classification Search
CPC ..... F28F 9/0246; F28F 9/0253; F28F 9/0265; F28F 9/027; F28F 9/0273; F28F 9/0278; F28F 9/028; F28F 9/0282; F28D 1/0477
See application file for complete search history.

(56) References Cited

U.S. PATENT DOCUMENTS 3,209,820 A 10/1965 Lauterbach
3,864,938 A * 2/1975 Hayes, Jr. ..... F28F 9/0282 62/504
5,241,839 A * 9/1993 Hughes ..... B60H 1/3227 165/174
5,242,016 A * 9/1993 Voss ..... F25B 39/028 165/173
5,295,532 A * 3/1994 Hughes ..... F28F 9/0204 165/76
5,934,367 A 8/1999 Shimmura et al.
6,892,805 B1 * 5/2005 Valensa ..... F28F 9/0278 165/173
7,086,249 B2 8/2006 Bae et al.
7,562,697 B2 7/2009 Gorbounov et al.
7,967,060 B2 6/2011 Trumbower et al.
8,083,026 B1 * 12/2011 Butler ..... F01N 1/083 181/264
8,171,987 B2 5/2012 Jiang et al.
8,302,673 B2 11/2012 Taras et al.
8,561,680 B2 * 10/2013 Jiang ..... F28F 9/0273 165/174
8,590,607 B2 * 11/2013 Demuth ..... F28D 1/0478 165/176
8,931,509 B2 1/2015 Beard
9,644,905 B2 5/2017 Rusich
9,976,820 B2 * 5/2018 Okazaki ..... F28F 9/028
10,563,895 B2 * 2/2020 Mislak ..... F25B 49/02
10,571,205 B2 * 2/2020 Higashiiue ..... F28D 1/0476
11,092,388 B2 * 8/2021 Dziubinschi ..... F28F 9/028
2003/0188857 A1 * 10/2003 Kawakubo ..... F28F 9/0243 165/174
2005/0039901 A1 * 2/2005 Demuth ..... F28D 1/0478 165/175
2006/0102332 A1 * 5/2006 Taras ..... F25B 39/028 165/174
2008/0092587 A1 * 4/2008 Gorbounov ..... F28F 9/0224 62/498
2008/0093051 A1 * 4/2008 Rios ..... F28F 9/0273 165/61
2010/0089559 A1 * 4/2010 Gorbounov ..... F25B 39/028 165/174
2011/0000255 A1 * 1/2011 Taras ..... F25B 39/028 62/498
2011/0127023 A1 6/2011 Taras et al.
2011/0139421 A1 * 6/2011 Coyle ..... F28D 1/05391 165/173
2011/0203308 A1 8/2011 Chiang et al.
2011/0240276 A1 10/2011 Wintersteen et al.
2011/0290465 A1 * 12/2011 Joshi ..... F28F 9/0273 165/175
2015/0122470 A1 5/2015 Xia et al.
2015/0345843 A1 * 12/2015 Voorhis ..... F28F 9/0273 62/504
2016/0018167 A1 * 1/2016 Dziubinschi ..... F28F 3/044 165/177
2016/0040942 A1 * 2/2016 Dziubinschi ..... F28F 9/005 165/135
2016/0061497 A1 3/2016 Chowdhury et al.
2016/0076823 A1 * 3/2016 Okazaki ..... F28F 9/22 165/174
2016/0116231 A1 * 4/2016 Higashiiue ..... F25B 39/00 165/174
2018/0156512 A1 * 6/2018 Mislak ..... F25B 39/028
2021/0215430 A1 * 7/2021 Sugimura ..... F28D 1/05391
2022/0120479 A1 * 4/2022 Hirokawa ..... F28F 9/22

FOREIGN PATENT DOCUMENTS

JP 2022043207 A * 3/2022
WO WO-2020089966 A1 * 5/2020 ..... F25B 39/022
WO WO-2020217271 A1 * 10/2020
WO WO-2021149223 A1 * 7/2021

* cited by examiner

ADJUSTABLE INLET HEADER FOR HEAT EXCHANGER OF AN HVAC SYSTEM

CROSS REFERENCE TO RELATED APPLICATIONS

This application is a divisional of U.S. patent application Ser. No. 15/611,605, filed Jun. 1, 2017, entitled "ADJUSTABLE INLET HEADER FOR HEAT EXCHANGER OF AN HVAC SYSTEM," which claims priority from and the benefit of U.S. Provisional Application Ser. No. 62/431,221, filed Dec. 7, 2016, entitled "ADJUSTABLE INLET HEADER FOR FIN AND TUBE EVAPORATOR COILS," the disclosures of which are hereby incorporated by reference in their entireties for all purposes.

BACKGROUND

The present disclosure relates generally to heat exchangers utilized in heating, ventilation, and air conditioning (HVAC) systems. Evaporators and condensers of an HVAC system generally utilize heat exchangers to control a temperature of an external fluid, such as air, passing over tubes of the heat exchangers. For example, each heat exchanger generally includes tubes for flowing refrigerant (e.g., R-410A, steam, or water) between headers that are connected to a refrigerant inlet and outlet. As refrigerant flows through the tubes, the refrigerant may exchange heat with air flowing over or between the tubes. The air may then be distributed to a commercial or residential space requiring temperature-controlled air.

In many HVAC systems, the refrigerant undergoes a phase change while flowing through (or to) the heat exchangers in which evaporation or condensation occur. Generally, a portion of the heat transfer is achieved from the phase change that occurs within and/or immediately adjacent the heat exchanger. That is, while some energy is transferred to and from the refrigerant by changes in the temperature of the fluid (i.e., sensible heat), other of the energy is exchanged by phase changes (i.e., latent heat). Thus, the heat exchanger (e.g., of the evaporator, of the condenser) generally handles two-phase flow (e.g., part liquid, part vapor). Efficiency of the evaporator is improved by improving homogeneity of the two-phase flow, and by equalizing distribution of the refrigerant to the tubes. Unfortunately, traditional HVAC heat exchanger (e.g., evaporator) configurations may regularly cause heterogeneous two-phase flow. Accordingly, improved heat exchangers are desired.

SUMMARY

The present disclosure relates to a heat exchanger of an HVAC system including an inlet header, an outlet header, and tubes configured to extend between the inlet header and the outlet header. The system also includes a first interchangeable refrigerant distributor segment of the inlet header, where the first interchangeable refrigerant distributor segment includes first orifices configured to fluidly couple with the tubes to facilitate distribution of refrigerant from the inlet header to the tubes in a first configuration. The system also includes a second interchangeable refrigerant distributor segment of the inlet header, where the second interchangeable refrigerant distributor segment includes second orifices configured to fluidly couple with the tubes to facilitate distribution of refrigerant from the inlet header to the tubes in a second configuration. The first orifices include a first characteristic of orifice cross-sectional internal boundary size or shape, and the second orifices include a second characteristic of orifice cross-sectional internal boundary size or shape different than the first characteristic.

The present disclosure also relates to a heating, ventilation, and air conditioning (HVAC) system. The HVAC system includes a fin-and-tube heat exchanger configured to receive a refrigerant of the HVAC system, where the fin-and-tube heat exchanger includes an inlet header, tubes opening into the inlet header, and a refrigerant distributor disposed in the inlet header and having orifices fluidly and removably coupled with the tubes extending into the inlet header.

The present disclosure also relates to a method of operating a heat exchanger of an HVAC system. The method includes distributing, via an inlet header, a refrigerant through first refrigerant distribution orifices to tubes of the heat exchanger. The method also includes detecting, via a sensor, an operating condition of the HVAC system. The method also includes adjusting the inlet header, based on the operating condition of the HVAC system, to fluidly couple second refrigerant distribution orifices different than the first refrigerant distribution orifices with the tubes of the heat exchanger. The method also includes distributing, via the inlet header, the refrigerant through the second refrigerant distribution orifices to the tubes of the heat exchanger.

DRAWINGS

DETAILED DESCRIPTION

Figure 1:
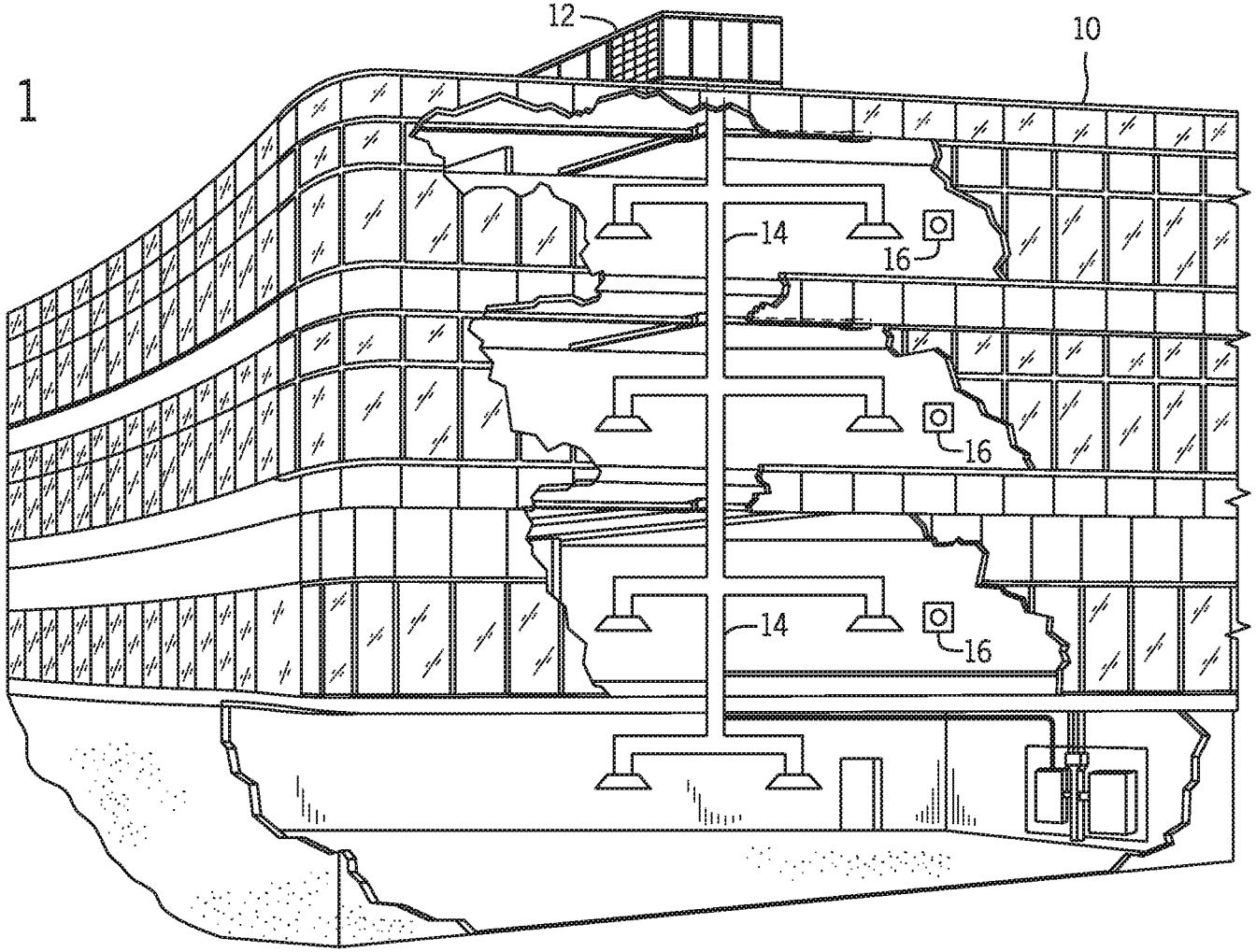
FIG. 1 is a perspective view of an embodiment of a heating, ventilating, and air conditioning (HVAC) system for building environmental management that employs one or more HVAC units, in accordance with an aspect of the present disclosure.

The present disclosure is directed toward heat exchangers of a commercial, industrial, or residential heating, ventilation, air conditioning, and refrigerant system ("HVAC system"). For example, the HVAC system may include an evaporator and a condenser. Refrigerant (e.g., R-410A, steam, or water) flowing through tubes of a heat exchanger of the condenser may reject heat to an external fluid (e.g., air) flowing over the tubes of the heat exchanger, such that the refrigerant changes phases from a vapor or gas to a liquid. Refrigerant flowing through tubes of a heat exchanger of the evaporator may receive heat from an external fluid (e.g., air) flowing over the tubes, such that the refrigerant changes phases from a liquid to a vapor or gas. In other words, the condenser heat exchanger, the evaporator heat exchanger, or both may include or receive refrigerant having two-phase flow.

In accordance with present embodiments, certain of the heat exchangers of the HVAC system may include a customizable inlet header configured to distribute the refrigerant to the tubes. For example, the customizable inlet header may include a refrigerant distributor having orifices that enable passage of refrigerant from the customizable inlet header, through the orifices, and to the tubes. In other words, the orifices are configured to fluidly couple the customizable inlet header with the tubes.

The refrigerant distributor of the customizable inlet header may be adjustable to change a characteristic (e.g., shape, size) of a cross-sectional internal boundary size or shape of the orifices that fluidly couple the customizable inlet header with the tubes. For example, the refrigerant distributor may be substantially cylindrical, although polygonal prisms (e.g., rectangular prism, hexagonal prism, octagonal prism, etc.) may also be used, and may be received by a shell of the customizable inlet header. The cylindrical refrigerant distributor may include an internal space or cavity that receives the refrigerant in an internal space of the shell of the inlet header. The cylindrical refrigerant distributor may also include columns of orifices extending through an outer wall of the cylindrical refrigerant distributor, where the outer wall defines the internal space or cavity of the cylindrical refrigerant distributor. Each column of orifices includes an orifice characteristic (e.g., a certain size or a certain shape of the cross-sectional internal boundary) corresponding with said column. Each column may correspond with a circumferential segment of the cylindrical refrigerant distributor, and the cylindrical refrigerant distributor may be rotatable about a longitudinal axis of the cylindrical refrigerant distributor to fluidly couple a particular column of orifices with the tubes of the heat exchanger (e.g., based on operating conditions). In other words, the orifices of each column may be spaced to align with the tubes.

As set forth above, each column of orifices may include a particular orifice characteristic. For example, a first column of orifices may include circular orifices, a second column of orifices includes rectangular orifices, and the first and second columns may be selectable depending on operating conditions of the HVAC system.

Other refrigerant distributors may be possible. For example, in another embodiment, the customizable inlet header may include a shell defining an internal cavity configured to receive a translatable refrigerant distributor plate (e.g., a rectangular translatable refrigerant distributor plate). A first translatable refrigerant distributor plate may include orifices of a first type (e.g., size or shape), and a second translatable refrigerant distributor plate may include orifices of a second type different than the first type (e.g., different size or shape). Thus, depending on operating conditions, the first translatable refrigerant distributor plate may be disposed in the internal cavity of the customizable inlet header, or the second translatable refrigerant distributor plate may be disposed in the internal cavity. If the operating condition changes beyond a threshold amount, the translatable refrigerant distributor plate within the cavity of the shell of the customizable inlet header may be slid out of the cavity, and replaced with the other of the translatable refrigerant distributor plates. In other words, the translatable refrigerant distributor plates are standardized to interface with the tubes.

In still further embodiments, a single translatable refrigerant distributor plate may be used. The single translatable refrigerant distributor plate may include a column of orifices, where the single translatable refrigerant distributor plate is translatable to align a certain subset of the orifices in the column with the tubes (or inlets thereof) of the heat exchanger. For example, the lowermost orifice may include a circular orifice, and every other orifice therefrom includes the circular orifice, while the second lowermost orifice includes a square orifice, and every other orifice therefrom includes the square orifice. In other words, a first subset of orifices may include circular orifices, while a second subset of orifices may include square orifices. The translatable refrigerant distributor plate may be slid upwardly or downwardly (i.e., translated) to interface the first subset of orifices or the second subset of orifices with the tubes (or inlets thereof) of the heat exchanger (e.g., depending on operating conditions). As previously described, the subsets of orifices may be defined by other characteristics, such as different sizes instead of different shapes. As described above, the particular characteristic of the orifices selected to align with (and fluidly couple to) the tubes of the heat exchanger may be determined based on an operating condition of the HVAC system. Thus, the type of orifice selected for distributing the refrigerant from the customizable inlet header to the tubes may be determined in order to improve homogeneity of two-phase flow of the refrigerant through the heat exchanger, and to equalize distribution of the refrigerant to the tubes.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
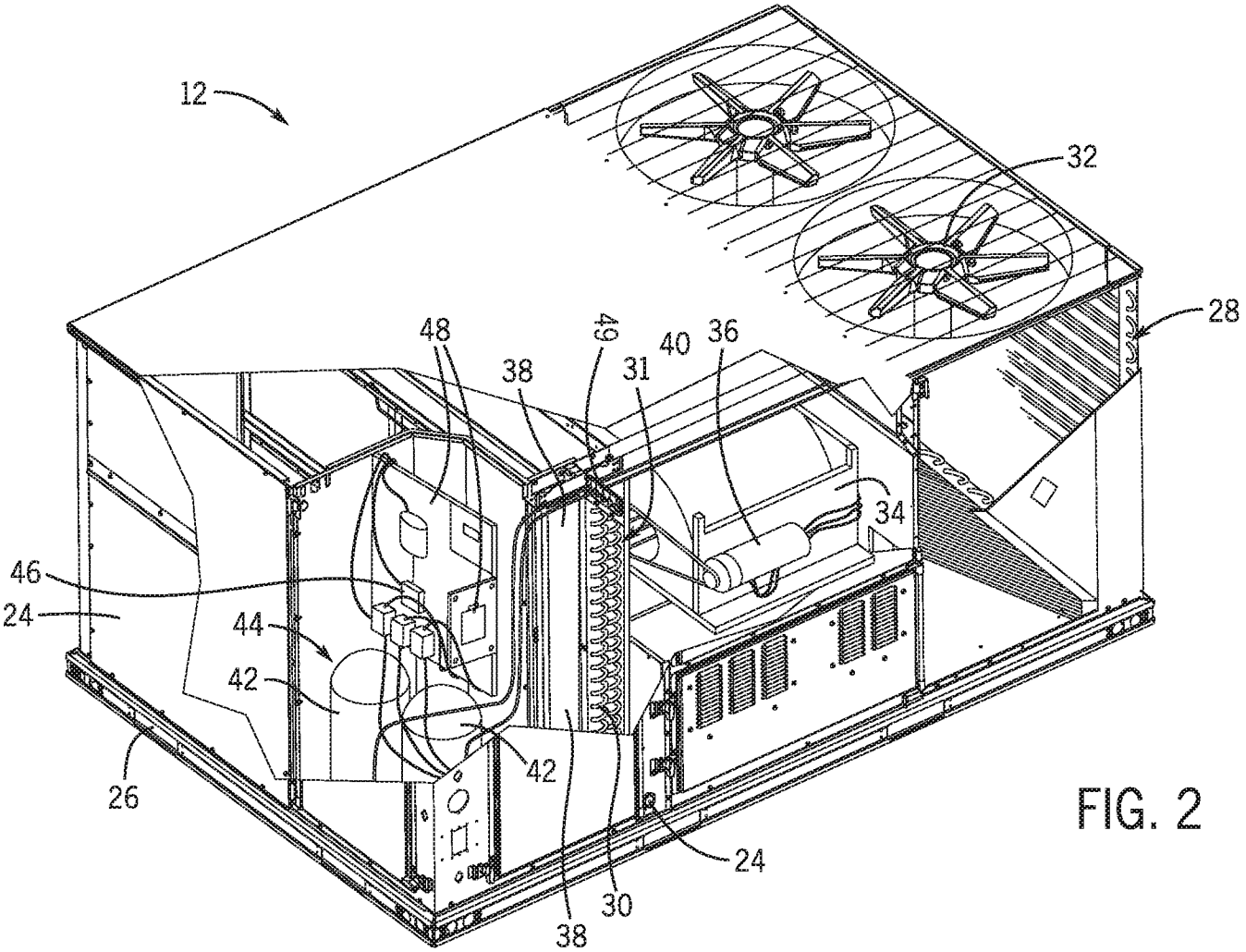
FIG. 2 is a perspective cut-away view of an embodiment of one of the HVAC units of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. Wiring 49 may connect the control board 48 and the terminal block 46 to the equipment of the HVAC unit 12.

Figure 3:
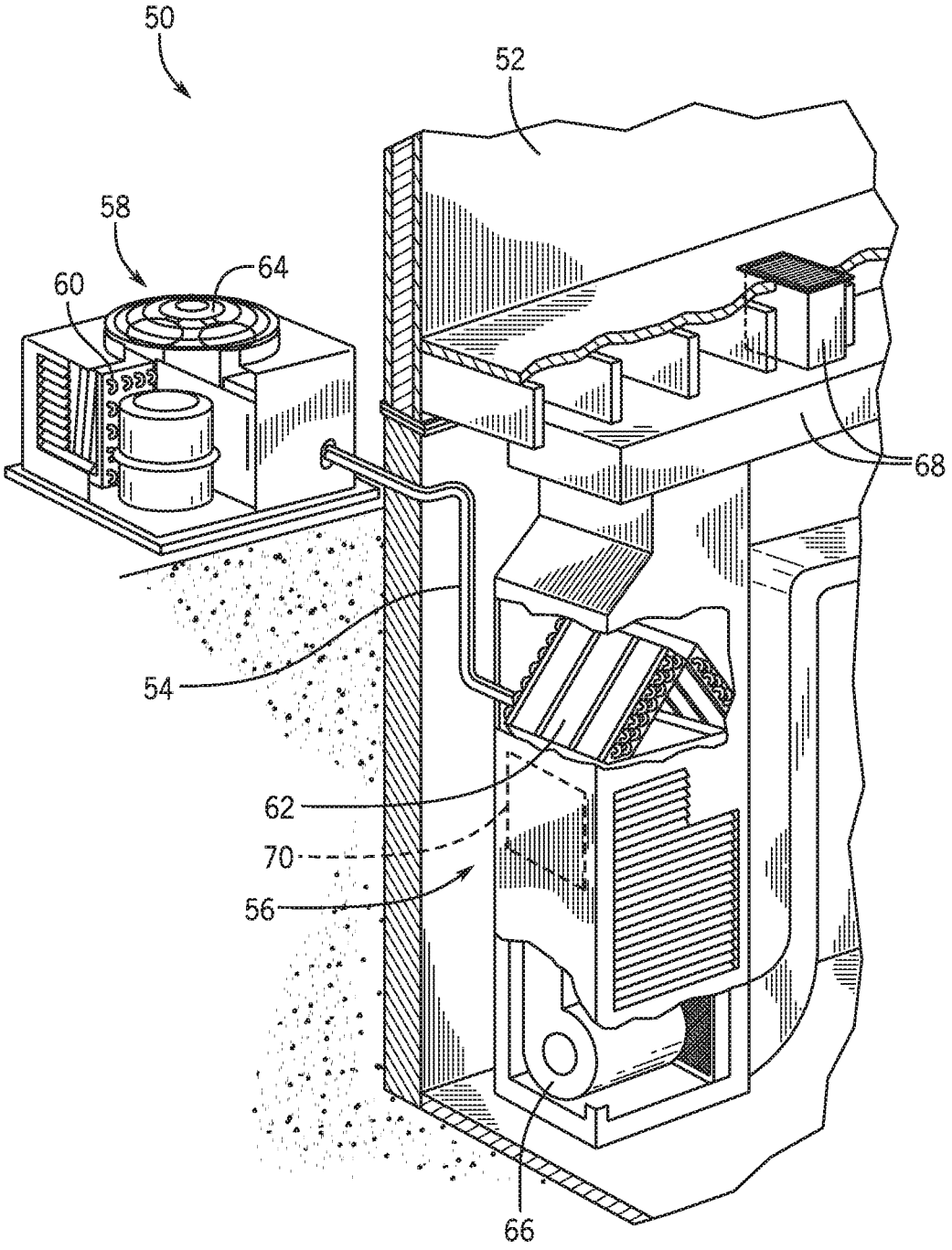
FIG. 3 is a perspective cut-away view of an embodiment of a residential heating and cooling system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
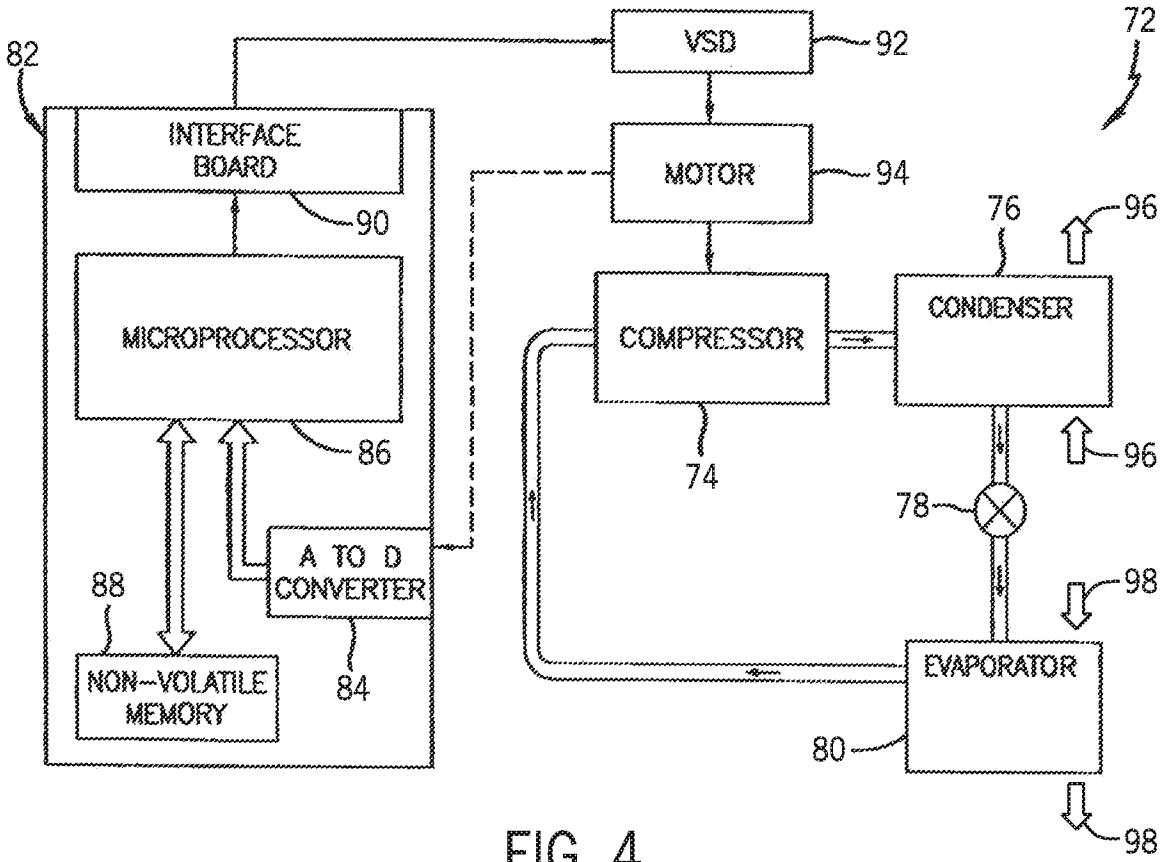
FIG. 4 is a schematic illustration of an embodiment of a vapor compression system for use in any of the systems or units of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

FIGS. 5-11 are directed toward embodiments of a customizable inlet header (and/or subcomponents thereof), in accordance with the present disclosure. It should be understood that the customizable inlet header is included in the various systems illustrated in FIGS. 1-4. Each of FIGS. 5-11 will be described individually, and in detail, below.

Figure 5:
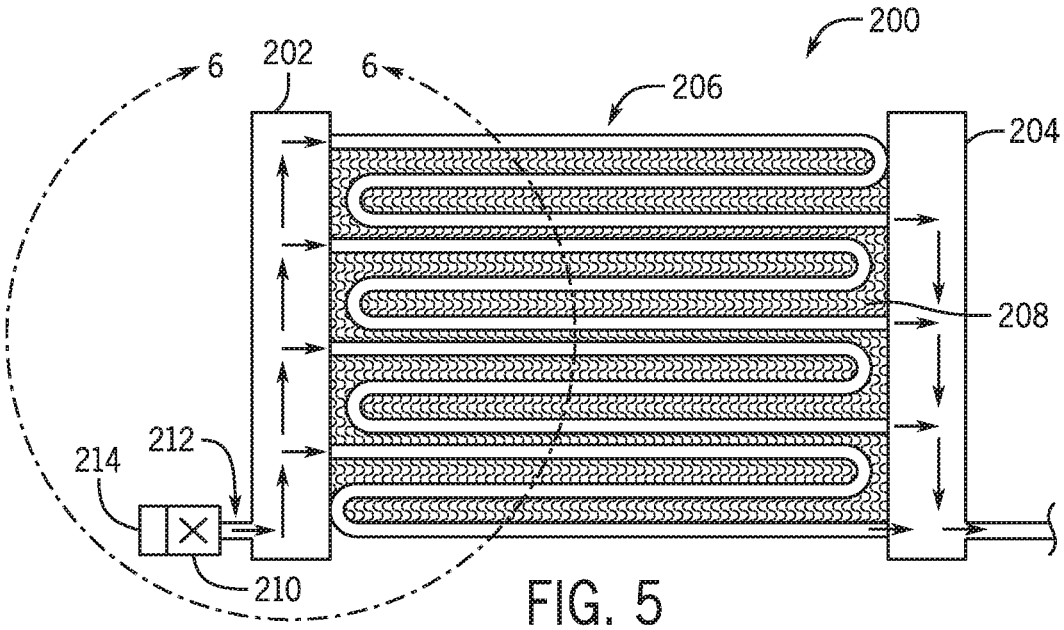
FIG. 5 is a front view of an embodiment of a fin-and-tube heat exchanger for use in any of the systems of FIGS. 1-4, in accordance with an aspect of the present disclosure.

FIG. 5 is a front view of an embodiment of a fin-and-tube heat exchanger 200 used in the aforementioned systems (e.g., of FIGS. 1-4). The fin-and-tube heat exchanger 200 may include a customizable inlet header 202, an outlet header 204, and tubes 206 extending between the customizable inlet header 202 and the outlet header 204. In the illustrated embodiment, each tube 206 is a three-pass tube, although each tube 206 in another embodiment may include a one-pass tube, a five-pass tube, a seven-pass tube, or so on.

In general, the tubes 206 of the fin-and-tube heat exchanger 200 may include a copper material. Fins 208 of the heat exchanger 200 may intertwine about the tubes 206, and may include an aluminum material. The heat exchanger 200 also includes an inlet 210 to the customizable inlet header 202, and copper tubing 212 extending between the customizable inlet header 202 and the inlet 210 to the customizable inlet header 202. The inlet 210 may include a valve configured to selectively enable flow of refrigerant into the copper tubing 212 and toward the customizable inlet header 202. In some embodiments, an expansion device 214 may be incorporated with the inlet 210, or may be positioned elsewhere. The expansion device 214 may cause at least a portion of the refrigerant to change from a liquid to a vapor prior to the refrigerant reaching the customizable inlet header 202 (or an internal space thereof). As the inlet 210 allows the refrigerant to pass to the copper tubing 212, the copper tubing 212 may accelerate the refrigerant into the customizable inlet header 202. The copper material of the tubes 206 may additionally accelerate the refrigerant through the heat exchanger 206.

As a fluid (e.g., air) passes over the tubes 206 of the heat exchanger 200, the refrigerant (e.g., R-410A, steam, water) flowing through the tubes 206 extracts heat from the air, causing the refrigerant to change phases from a liquid to a vapor. However, as previously described, a portion of the refrigerant may change phases from a liquid to a vapor prior to entering the tubes 206. The customizable inlet header 202 may include adjustable features (e.g., orifices) that improve homogeneity of the two-phase flow, and that equalize distribution of the refrigerant to the tubes 206 (e.g., based on an operating condition or characteristic of the heat exchanger 200, the refrigerant, or the system employing the heat exchanger 200). For example, a first subset of orifices having a circular shape may be selected during a first operating condition, and a second subset of orifices having a rectangular or square shape may be selected during a second operating condition different than the first operating condition. Other characteristics of the orifices are also possible, and will be described in detail, along with a summary of the mechanisms enabling the selection of various orifices, below.

Figure 6:
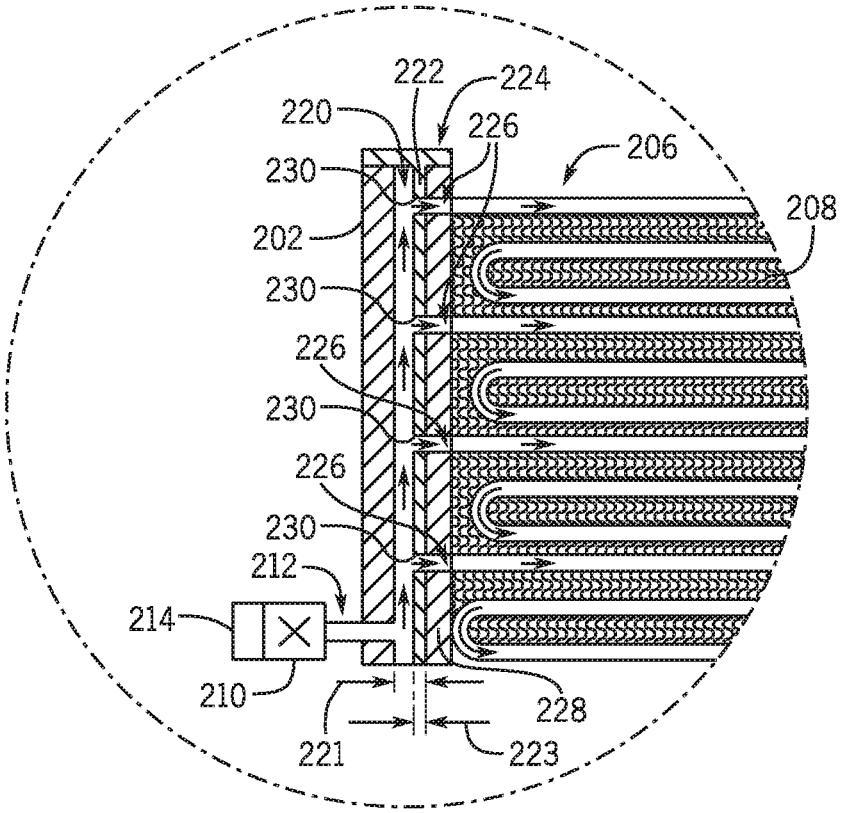
FIG. 6 is an close-up cross-sectional view of an embodiment of a customizable inlet header for use in the fin-and-tube heat exchanger of FIG. 5, taken along line 6-6 of FIG. 5, in accordance with an aspect of the present disclosure.

FIG. 6 is a close-up cross-sectional view of an embodiment of the customizable inlet header 202 for use in the fin-and-tube heat exchanger 200 of FIG. 5, taken along line 6-6 of FIG. 5. A cross-sectional view is employed to illustrate an internal space 220 defined by a wall 228 (e.g., shell) of the customizable inlet header 202. The internal space 220 is configured to receive an interchangeable refrigerant distributor 222 (e.g., distributor segment). As illustrated, the internal space 220 is sized to house the interchangeable refrigerant distributor 222 and receive refrigerant simultaneously (e.g., because the internal space 220 includes a cross-sectional width 221 greater than a second cross-sectional width 223 of the interchangeable refrigerant distributor 222, as shown).

The interchangeable refrigerant distributor 222 in the illustrated embodiment includes a cap plate 224 that facilitates appropriate positioning of the distributor 222 with respect to openings 226 through the wall 228 (e.g., shell) of the customizable inlet header 202. The tubes 206 are coupled with the wall 228 (e.g., shell) such that the tubes 206 align with the openings 226 in the wall 228 (e.g., shell). In some embodiments, the tubes 206 are rigidly or fixedly coupled with the wall 228 (e.g., shell). The interchangeable refrigerant distributor 222 includes orifices 230 that, when the distributor 222 is positioned appropriately in the internal space 220 of the customizable inlet header 202, align with the openings 226. The orifices 230 of the interchangeable refrigerant distributor 222 may include a particular size, a particular shape, or both that improves homogeneity of the two-phase flow of refrigerant into the tubes 206, and equalizes distribution of the refrigerant to the tubes 206, during a particular operating condition.

Figure 7:
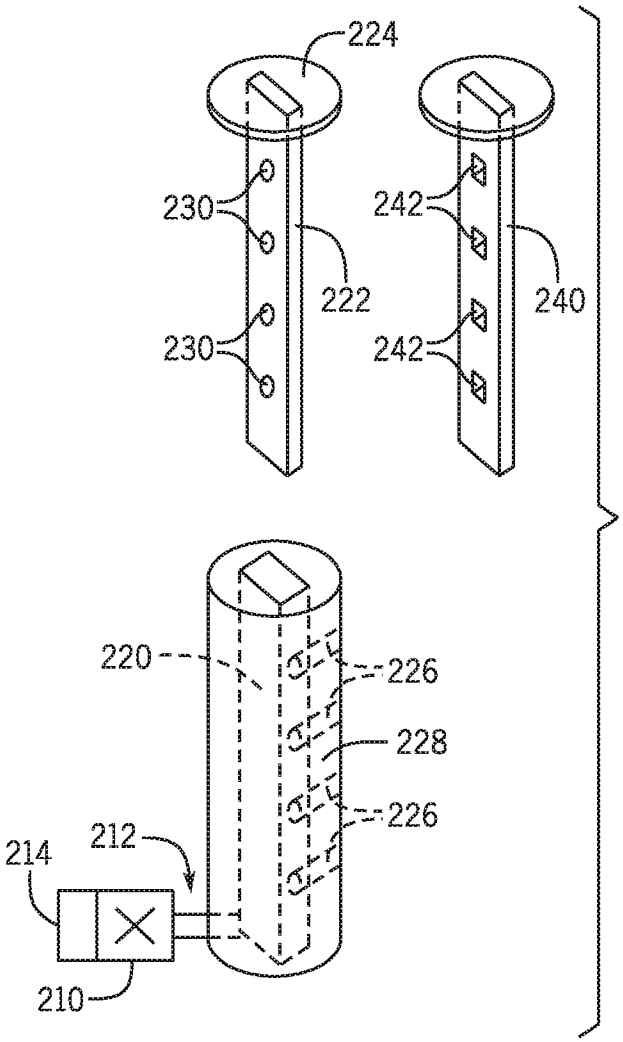
FIG. 7 is an exploded perspective view of an embodiment of a customizable inlet header for use in the fin-and-tube heat exchanger of FIG. 5, in accordance with an aspect of the present disclosure.

If the operating condition changes beyond a threshold amount associated with use of the interchangeable refrigerant distributor 222, an additional interchangeable refrigerant distributor (not shown) having different orifices that are more compatible with the current operating condition may replace the illustrated interchangeable refrigerant distributor 222. For example, FIG. 7 is an exploded perspective view of an embodiment of the customizable inlet header 202 for use in the fin-and-tube heat exchanger 206 of FIG. 5. In the illustrated embodiment, the interchangeable refrigerant distributor 222 is illustrated (in the exploded view) above the internal space 220 of the customizable inlet header 202. An additional interchangeable refrigerant distributor 240 is also shown, and may be used when operating conditions are such that the additional interchangeable refrigerant distributor 240 improves operation of the heat exchanger corresponding with the customizable inlet header 202 (e.g., compared with the first interchangeable refrigerant distributor 222).

For example, as shown, the additional interchangeable refrigerant distributor 240 includes orifices 242 having a square shape. However, the orifices 242 of the additional interchangeable refrigerant distributor 240 may include some other characteristic that differentiates the orifices 242 from the orifices 230 of the interchangeable refrigerant distributor 222 disposed above the customizable inlet header 202. For example, the orifices 242 may include a different cross-sectional area than the orifices 230, a different length (e.g., depth) than the orifices 230 (e.g., corresponding with relative thicknesses of walls of the distributors 222, 242), or some other distinguishing characteristic. As previously described, the distributors 222, 242 may be interchanged manually or automatically. For example, a control feedback system, as explained in detail with reference to later figures, may be used to index and/or replace the distributors 222, 242, or to otherwise change the distributor orifices distributing refrigerant to the tubes of the heat exchanger. It should be noted that, when orifices of a particular distributor are fluidly coupled with the tubes, the orifices may be referred to as "operational" orifices. It should also be noted that components/features which are "fluidly coupled" are aligned, engaged, or corresponding to enable fluid flow between the components/features.

Figure 8:
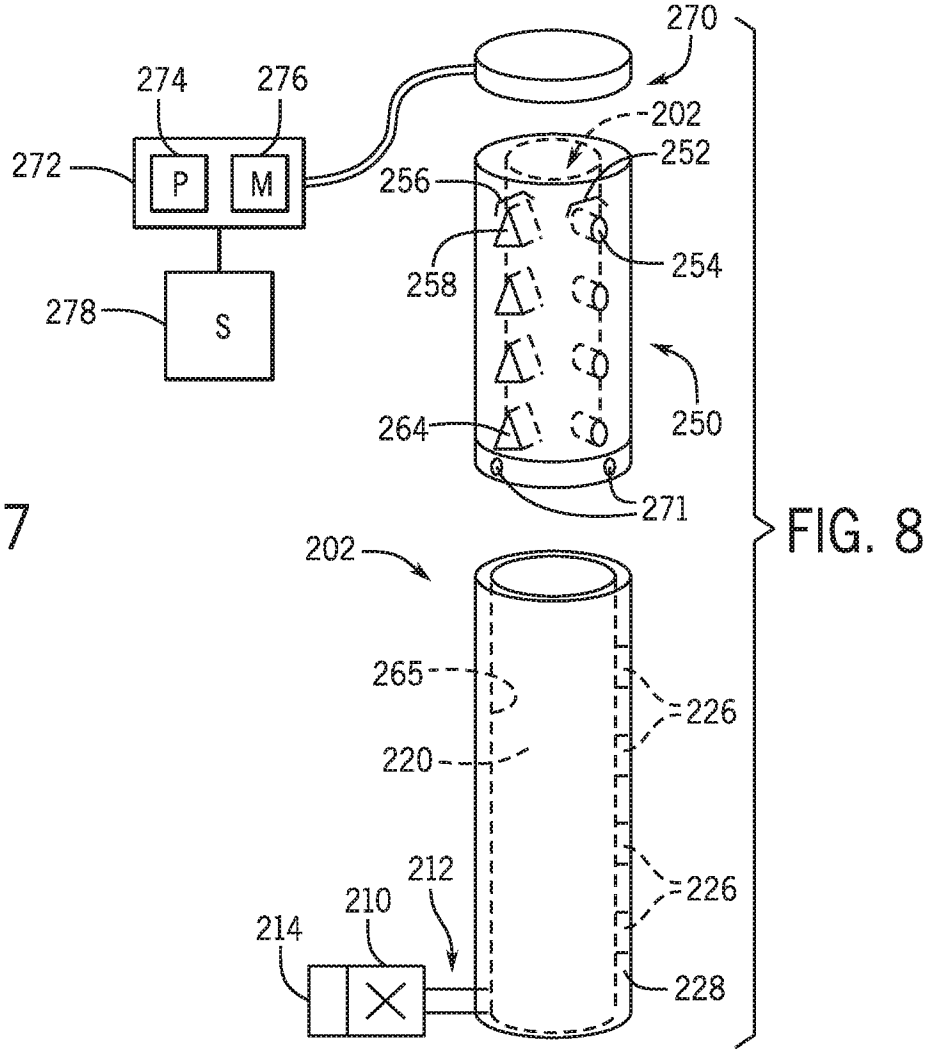
FIG. 8 is an exploded perspective view of an embodiment of a customizable inlet header for use in the fin-and-tube heat exchanger of FIG. 5, in accordance with an aspect of the present disclosure.

FIG. 8 is an exploded perspective view of an embodiment of a customizable inlet header 202 for use in the fin-and-tube heat exchanger 206 of FIG. 6. In the illustrated embodiment, the customizable inlet header 202 includes a cylindrical refrigerant distributor 250 having columns 252, 256 of orifices 254, 258 extending outwardly therefrom. For example, a first column 252 of circular orifices 254 and a second column 256 of triangular orifices 258 are shown, although other columns may also be used. The circular orifices 254 and the triangular orifices 258 extend to an internal cavity 262 of the cylindrical refrigerant distributor 250.

The cylindrical refrigerant distributor 250 is positioned within the internal space 220 of the customizable inlet header 202 such that one of the columns 252, 256 aligns with the openings 226 in the wall 228 (e.g., shell) of the customizable inlet header 202, where, as previously described, tubes are configured to fluidly couple with the openings 226. Further, an inlet ring 269 may be positioned on the cylindrical refrigerant distributor 250. The inlet ring 269 may enable the refrigerant to flow from the copper tubing 212 adjacent the inlet 210 of the customizable inlet header 202 to the internal space 262 of the cylindrical refrigerant distributor 250. Indeed, the inlet ring 269 in the illustrated embodiment includes openings 271 configured to fluidly couple with the copper tubing 212.

In some embodiments, a motor 270 may be positioned above the cylindrical refrigerant distributor 250, such that the motor 270 may rotate the cylindrical refrigerant distributor 250 to couple a desired one of the columns 252, 256 with the openings 226. Further, a controller 272 may be employed to control rotation of the cylindrical refrigerant distributor 250, where the controller 272 includes a processor 274 and a memory 276. The memory 276 may include instructions stored thereon that, when executed by the processor 274, cause the controller 272 to perform various acts. For example, the processor 274 may receive data from a sensor 278 configured to detect an operating condition, for example, of the refrigerant (e.g., a pressure of the refrigerant, a temperature of the refrigerant, a phase composition of the refrigerant, etc.). The processor 274 may determine a desired one of the columns 252, 256 based on the feedback from the sensor 278, and the controller 272 may then instruct the motor 270 to rotate the cylindrical refrigerant distributor 250 to fluidly couple (e.g., align and/or engage to facilitate fluid flow through the orifices and openings in the header to the tubes) the desired column 252, 256 of orifices 254, 268 with the openings 226 in the wall 228 (e.g., shell) of the customizable inlet header 202. In this way, each of the columns 252, 256 may act similarly as the aforementioned interchangeable refrigerant distributors. In other words, each column 252, 256 may be an interchangeable segment of the cylindrical refrigerant distributor 250. It should be noted that, when orifices of a particular distributor are fluidly coupled with the tubes, the orifices may be referred to as "operational" orifices. It should also be noted that components/features which are "fluidly coupled" are aligned, engaged, or corresponding to enable fluid flow between the components/features.

It should be noted that, in embodiments where the refrigerant distributor itself includes an internal cavity configured to receive the refrigerant (e.g., such as the cylindrical refrigerant distributor 250 having the internal cavity 262 illustrated in FIG. 8), the inlet header 202 may not include the wall 228 as a shell (e.g., that extends circumferentially about the refrigerant distributor). The wall 228 may instead be, for example, a plate that receive the tubes of the heat exchanger (not shown) on a first side, and fluidly couples with orifices of the refrigerant distributor on a second side opposite the first side. Thus, the wall 228 may be disposed between the refrigerant distributor and the tubes to which the refrigerant distributor distributes the refrigerant (e.g., for stabilization purposes), and may not extend around (or encompass) the refrigerant distributor. Thus, the refrigerant distributor (e.g., the cylindrical refrigerant distributor 250 illustrated in FIG. 9) may be at least partially exposed to view, as the wall 228 of the customizable inlet header 202 may not extend 360 degrees about the cylindrical refrigerant distributor 250. It should be noted that certain embodiments including a plate-like distributor (e.g., similar to those shown in FIGS. 6, 7, and 9) may include an internal cavity of the plate-like distributor that fluidly couples with the orifices of the plate-like distributor. In such embodiments, the wall 228 (e.g., shell) of the customizable inlet header 202 may or may not fully encompass the plate-like distributor, as described above.

Figure 9:
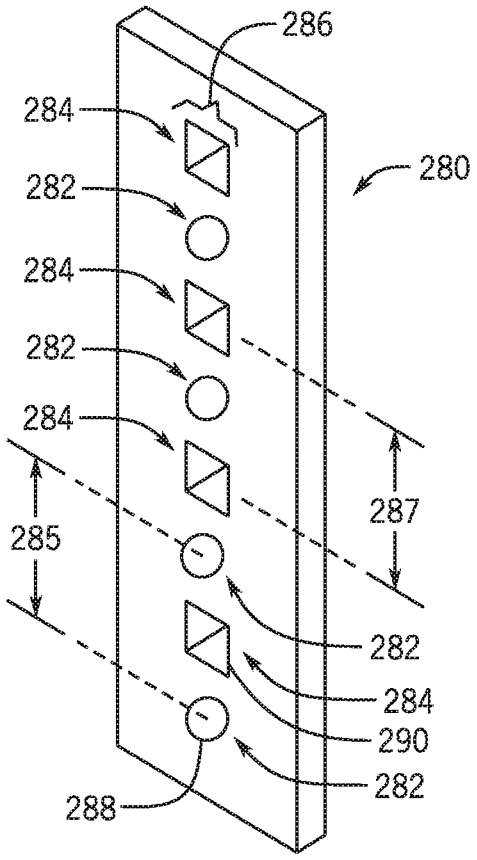
FIG. 9 is a perspective view of an embodiment of an interchangeable refrigerant distributor for use in a customizable inlet header of the fin-and-tube heat exchanger of FIG. 5, in accordance with an aspect of the present disclosure.

FIG. 9 is a perspective view of an embodiment of a slidable refrigerant distributor 280 (e.g., interchangeable refrigerant distributor) for use in the customizable inlet header of the fin-and-tube heat exchanger of FIG. 5. The illustrated slidable refrigerant distributor 280 includes two subsets 282, 284 (e.g., segments) of orifices, where a first subset 282 (e.g., first segment) of orifices includes circular orifices, and a second subset 284 (e.g., second segment) of orifices includes square orifices. The two subsets 282, 284 form a single column 286 of orifices on the slidable refrigerant distributor 280. A lowermost orifice 288 belongs to the first subset 282, a second lowermost orifice 290 belongs to the second subset 284, and the orifices of the subsets 282, 284 alternate moving upwardly along the slidable refrigerant distributor 280. In this way, a first pitch 285 (e.g., first distance) between the orifices of the first subset 282 is the same as a second pitch 287 (e.g., second distance) between the orifices of the second subset 284.

The aforementioned pitch 285, 287 also corresponds with a pitch between openings (e.g., in a wall of a customizable inlet header [not shown]) to tubes of a heat exchanger (not shown), as previously described. Thus, the slidable refrigerant distributor 280 may be positioned such that the first subset 282 of circular orifices aligns with the openings in the wall of the customizable inlet header (not shown) during a first operating condition (e.g., to distribute the refrigerant through the openings in the wall of the customizable inlet header to the tubes). The slidable refrigerant distributor 280 may be adjusted (e.g., re-positioned or slid within the customizable inlet header [not shown]) such that the second subset 284 of square orifices aligns with the openings in the wall of the customizable inlet header (not shown) during a second operating condition different than the first operating condition (e.g., to distribute the refrigerant through the openings in the wall of the customizable inlet header to the tubes). A similar control system as described in FIG. 9, except including a motor that translates (e.g. slides) instead of rotates a component may be utilized to slide the slidable refrigerant distributor 280 (e.g., with respect to the openings of the customizable inlet header [not shown]). It should be noted that, when orifices of a particular subset are fluidly coupled with the tubes, the orifices may be referred to as "operational" orifices. It should also be noted that components/features which are "fluidly coupled" are aligned, engaged, or corresponding to enable fluid flow between the components/features.

Figure 10:
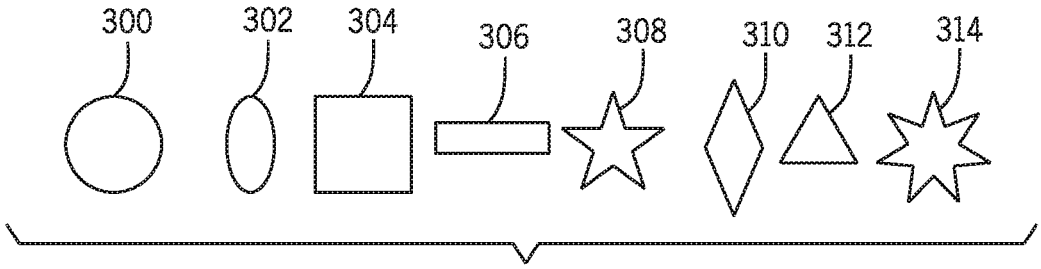
FIG. 10 is a schematic view of various shapes usable for orifices in a customizable inlet header of the fin-and-tube heat exchanger of FIG. 5, in accordance with an aspect of the present disclosure.

As previously described, the orifices of the aforementioned refrigerant distributors may include different shapes and/or sizes. FIG. 10 is a schematic view of various shapes usable for the orifices in the customizable inlet header of the fin-and-tube heat exchanger of FIG. 5. As shown, a circle 300 may be used, an oval or ellipse 302 may be used, a square 304 may be used, a rectangle 306 may be used, a star 308 may be used, a diamond 310 may be used, a triangle 312 may be used, a heptagram 314 may be used, or some other shape may be used. The particular shape of orifices selected for alignment with the distributor tubes (or intervening openings in the wall of the customizable inlet header to which the distributor tubes are coupled), as previously described, may be based on an operating condition (e.g., of the refrigerant or system). The selection may be manual or automatic, as previously described.

Figure 11:
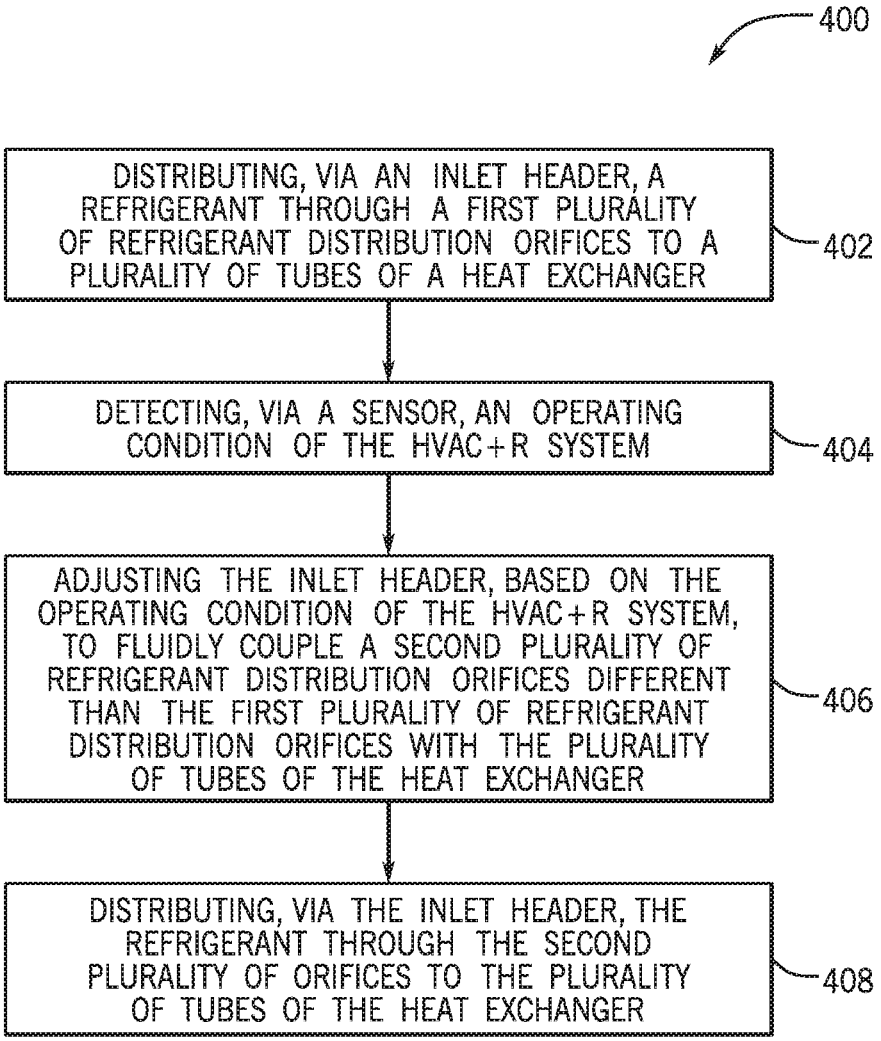
FIG. 11 is an embodiment of a method of distributing refrigerant to a heat exchanger of an HVAC system, in accordance with an aspect of the present disclosure.

FIG. 11 is an embodiment of a method 400 of distributing refrigerant to a heat exchanger of an HVAC system. In the illustrated embodiment, the method 400 includes distributing (block 402), via an inlet header (e.g., customizable inlet header), a refrigerant through first refrigerant distribution orifices to tubes of the heat exchanger. For example, as previously described, the refrigerant distribution orifices may align with the tubes (or with intervening openings of an intervening wall aligned with the tubes). The refrigerant may be accelerated into the customizable inlet header and the tubes by an expansion device and/or copper tubing. The first refrigerant distribution orifices may include a first characteristic that causes equal distribution of the refrigerant, and improves homogeneity of two-phase flow of the refrigerant to and through the tubes, during a first operating condition of the HVAC system. In some embodiments, several shapes and/or sizes of the orifices may be available for selection. In such embodiments, a tuning step may be conducted to determine the relative performance of each shape and/or size with respect to various operating conditions. For example, at each operating condition or within a defined range of operating conditions, the various shapes and/or sizes of the orifices may be tried, and results may be measured to identify the optimal configuration. An algorithm may be utilized to consider the results of the various arrangements or configurations to identify the optimal configuration.

The method 400 also includes detecting (block 404), via a sensor, the operating condition of the HVAC system. The sensor may sample the operating condition and send data indicative of the operating condition to a controller. The controller may analyze the operating condition to determine whether it is has exceeded a threshold amount, where the threshold amount would trigger a need to adjust the customizable inlet header to position different orifices in-line with the tubes of the heat exchanger.

The method 400 also includes adjusting (block 406) the customizable inlet header, based on the operating condition of the HVAC system, to fluidly couple second refrigerant distribution orifices different than the first refrigerant distribution orifices with the tubes of the heat exchanger. For example, as previously described, the controller may determine when the second refrigerant distribution orifices would be more desirable based on changes to the operating condition. In some embodiments, the best arrangement may be achieved by an algorithm that tries each arrangement and measures the results to identify the optimal configuration. Depending on the embodiment, the controller may rotate a cylindrical refrigerant distributor of the customizable inlet header to align the second distribution orifices with the tubes, the controller may slide a slidable refrigerant distributor of the customizable inlet header to align the second distribution orifices with the tubes, or the controller may swap a first distributor with a second distributor (e.g., and index the first distributor for later use). In some embodiments, the refrigerant distribution may be adjusted manually (e.g., if the controller signals to an operator that doing so would improve operation of the heat exchanger). After the customizable inlet header is adjusted in accordance with the above description, the method 400 also includes distributing (408), via the inlet header, the refrigerant through the second refrigerant distribution orifices to the tubes of the heat exchanger.

One or more of the disclosed embodiments, alone or in combination, may provide one or more technical effects useful in enhancing efficiency of a heat exchanger of an HVAC system. For example, in general, embodiments of the present disclosure include a customizable inlet header that enables selection of orifice size and shape to improve homogeneity of two-phase flow of refrigerant through the heat exchanger, and to equalize distribution of the refrigerant through the heat exchanger.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode of carrying out an embodiment, or those unrelated to enabling the claimed embodiments). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heat exchanger system of an HVAC system, the heat exchanger system comprising:

an inlet header configured to be coupled to a plurality of tubes configured to extend between the inlet header and an outlet header, wherein the inlet header comprises a shell and a cavity defined by the shell;

a first distributor plate configured to be disposed in the cavity of the inlet header such that a first plurality of orifices disposed in the first distributor plate fluidly couples with the plurality of tubes to facilitate distribution of a refrigerant from the cavity defined by the shell of the inlet header to the plurality of tubes, wherein the first plurality of orifices includes a first characteristic of orifice cross-sectional internal boundary size or shape;

a second distributor plate configured to be disposed in the cavity of the inlet header such that a second plurality of orifices fluidly couples with the plurality of tubes to facilitate distribution of the refrigerant from the cavity defined by the shell of the inlet header to the plurality of tubes, wherein the second plurality of orifices includes a second characteristic of orifice cross-sectional internal boundary size or shape different than the first characteristic; and an inlet to the inlet header and a tube configured to extend between the inlet to the inlet header and the cavity of the inlet header, wherein the tube is configured to guide the refrigerant therethrough and toward the cavity of the inlet header, and wherein the cavity is configured to receive the refrigerant and the first distributor plate, the second distributor plate, or both.

2. The heat exchanger system of claim 1, wherein a first wall of the first distributor plate includes a first thickness, the first plurality of orifices extends through the first wall and includes a first depth corresponding with the first thickness, a second wall of the second distributor plate includes a second thickness different than the first thickness, the second plurality of orifices extends through the second wall and includes a second depth corresponding with the second thickness, and the first depth is different than the second depth.

3. The heat exchanger system of claim 1, wherein the cavity defined by the shell of the inlet header is configured to receive only one of the first distributor plate or the second distributor plate in an assembled configuration.

4. The heat exchanger system of claim 1, wherein the cavity defined by the shell of the inlet header is configured to receive the first distributor plate and the second distributor plate at the same time.

5. The heat exchanger system of claim 1, wherein the inlet to the inlet header is configured to selectively enable passage of refrigerant to the tube, and wherein the tube is a copper tube.

6. The heat exchanger system of claim 5, wherein the shell includes openings therethrough, wherein a plurality of inlets to the plurality of tubes is configured to couple with the openings through the shell at a first side of the shell, wherein the first plurality of orifices of the first distributor plate is configured to interface with the openings through the shell at a second side of the shell opposite to the first side of the shell during a first configuration, and wherein the second plurality of orifices of the second distributor plate is configured to interface with the openings through the shell at the second side of the shell in a second configuration different than the first configuration.

7. The heat exchanger system of claim 1, wherein the shell comprises:

an inner surface defining the cavity of the inlet header;

an outer surface opposing the inner surface; and a plurality of shell openings extending through the shell, fluidly coupled with the cavity, and configured to be fluidly coupled with the plurality of tubes.

8. The heat exchanger system of claim 7, wherein:

the first distributor plate is configured to be disposed in the cavity defined by the shell of the inlet header such that the first plurality of orifices disposed in the first distributor plate fluidly couples with the plurality of tubes via the plurality of shell openings; and the second distributor plate is configured to be disposed in the cavity defined by the shell of the inlet header such that the second plurality of orifices disposed in the second distributor plate fluidly couples with the plurality of tubes via the plurality of shell openings.

9. The heat exchanger system of claim 1, wherein the first characteristic includes a first shape, and the second characteristic includes a second shape different than the first shape.

10. The heat exchanger system of claim 9, wherein the first shape is a circle.

11. The heat exchanger system of claim 9, wherein the first shape is a square, a rectangle, an oval, an ellipse, a star, a diamond, or a triangle.

12. A heating, ventilation, and air conditioning (HVAC) system, comprising:

a fin-and-tube heat exchanger configured to receive a refrigerant of the HVAC system, wherein the fin-and-tube heat exchanger comprises:

an inlet header having a shell, a cavity defined by an inner surface of the shell, and a plurality of shell openings through the shell;

a plurality of tubes coupled to an outer surface of the shell opposing the inner surface of the shell such that the plurality of shell openings through the shell are fluidly coupled with the plurality of tubes;

a first refrigerant distributor disposed in the cavity defined by the inner surface of the shell of the inlet header and having a first plurality of orifices fluidly and removably coupled with the plurality of shell openings;

a second refrigerant distributor configured to replace the first refrigerant distributor in the cavity defined by the inner surface of the shell of the inlet header and having a second plurality of orifices configured to fluidly and removably couple with the plurality of shell openings; and an inlet to the inlet header and a tube configured to extend between the inlet to the inlet header and the cavity of the inlet header, wherein the tube is configured to guide the refrigerant therethrough and toward the cavity of the inlet header, and wherein the cavity is configured to receive the refrigerant and the first distributor plate or the second distributor plate.

13. The HVAC system of claim 12, wherein the first characteristic is a first cross-sectional area and the second characteristic is a second cross-sectional area different than the first cross-sectional area.

14. The HVAC system of claim 12, wherein a first wall of the first refrigerant distributor includes a first thickness, the first plurality of orifices extends through the first wall and includes a first depth corresponding with the first thickness, a second wall of the second refrigerant distributor includes a second thickness different than the first thickness, the second plurality of orifices extends through the second wall and includes a second depth corresponding with the second thickness, and the first depth is different than the second depth.

15. The HVAC system of claim 12, wherein the cavity defined by the shell of the inlet header comprises a first cross-sectional width and the first refrigerant distributor comprises a second cross-sectional width that is less than the first cross-sectional width.

16. The HVAC system of claim 12, wherein:

a first orifice of the first plurality of orifices and a second orifice of the first plurality of orifices are spaced a first distance;

a first shell opening of the plurality of shell openings and a second shell opening of the plurality of shell openings are spaced a second distance; and the first distance is equal to the second distance, such that the first orifice is fluidly coupled with the first shell opening and the second orifice is fluidly coupled with the second shell opening.

17. The HVAC system of claim 12, wherein the first plurality of orifices comprises a first characteristic of orifice cross-sectional internal boundary size or shape, and the second plurality of orifices comprises a second characteristic of orifice cross-sectional internal boundary size or shape different than the first characteristic.

18. The HVAC system of claim 17, wherein the first characteristic is a first shape and the second characteristic is a second shape different than the first shape.

19. The HVAC system of claim 18, wherein the first shape is a circle.

20. The HVAC system of claim 18, wherein the first shape is a square, a rectangle, an oval, an ellipse, a star, a diamond, or a triangle.

* * * * *